US010752856B2

(12) United States Patent
Wang

(10) Patent No.: US 10,752,856 B2
(45) Date of Patent: Aug. 25, 2020

(54) FATTY ACID AND ROSIN BASED IONIC LIQUIDS

(71) Applicant: Ingevity South Carolina, LLC, North Charleston, SC (US)

(72) Inventor: Bing Wang, Mount Pleasant, SC (US)

(73) Assignee: INGEVITY SOUTH CAROLINA, LLC, North Charleston, SC (US)

( * ) Notice: Subject to any disclaimer, the term of this patent is extended or adjusted under 35 U.S.C. 154(b) by 117 days.

(21) Appl. No.: 15/988,721

(22) Filed: May 24, 2018

(65) Prior Publication Data

US 2018/0340129 A1 Nov. 29, 2018

Related U.S. Application Data

(60) Provisional application No. 62/510,732, filed on May 24, 2017.

(51) Int. Cl.

| | |
|---|---|
| ***C10M 105/00*** | (2006.01) |
| ***C10M 105/62*** | (2006.01) |
| ***C10M 105/24*** | (2006.01) |
| ***C10M 105/58*** | (2006.01) |

(52) U.S. Cl.

CPC ..... *C10M 105/62* (2013.01); *C10M 105/24* (2013.01); *C10M 105/58* (2013.01); *C10M 2207/183* (2013.01); *C10M 2207/203* (2013.01); *C10M 2215/023* (2013.01); *C10M 2215/0425* (2013.01); *C10M 2215/2245* (2013.01); *C10N 2220/04* (2013.01); *C10N 2230/06* (2013.01)

(58) Field of Classification Search

CPC ..... C10M 105/62; C10M 105/58; C10M 105/24; C10M 2215/2245; C10M 2207/183; C10M 2215/023; C10M 2215/0425; C10M 2207/203; C10N 2230/06; C10N 2220/04

See application file for complete search history.

(56) References Cited

U.S. PATENT DOCUMENTS

| | | | | |
|---|---|---|---|---|
| 7,858,802 | B2 * | 12/2010 | Maase | C07D 233/56 204/242 |
| 2005/0198894 | A1 | 9/2005 | Migdal et al. | |
| 2017/0009172 | A1 | 1/2017 | Bender et al. | |

FOREIGN PATENT DOCUMENTS

| | | | | |
|---|---|---|---|---|
| DE | 102011005441 | A1 * | 9/2011 | C10M 169/04 |
| GB | 2105743 | A | 3/1983 | |
| WO | 2006044411 | A1 | 4/2006 | |
| WO | WO 2013/158473 | | 10/2013 | |
| WO | WO 2015/140822 | | 9/2015 | |

OTHER PUBLICATIONS

Plechkova, et al., "Applications of ionic liquids in the chemical industry", Chem. Soc. Review. Jan. 2008; 37(1):123-50.

Welton, T., "Room-Temperature Ionic Liquids. Solvents for Synthesis and Catalysis". Chem. Review. Aug. 11, 1999; 99(8):2071-2084.

Ye, C et al., "Room-temperature ionic liquids: a novel versatile lubricant", Chem. Comm. Nov. 7, 2001(21):2244-5.

* cited by examiner

*Primary Examiner* — Taiwo Oladapo

(74) *Attorney, Agent, or Firm* — Bryan D. Zerhusen, Esq.; Kimberly Vines, Esq.; Cantor Colburn LLP

(57) ABSTRACT

The present disclosure provides an ionic liquid produced from a renewable source and with excellent lubricating properties, and methods of making the same. The ionic liquid includes an anion salt of at least one of a fatty acid, a rosin acid, or derivative thereof. The method for making the ionic liquid or lubricant composition of the present disclosure includes admixing a cation and an anion in a ratio of about a 1.5:1 to about 1:1.5 at room temperature to form a reaction mixture, wherein the anion comprises at least one of a fatty acid, a rosin acid, derivative thereof, or a combination thereof, and the cation comprises at least one of choline, imidazolium, pyridium, pyrrolidinium, ammonium, phosphonium, sulfonium, derivatives thereof, or combinations thereof; maintaining the reaction mixture at a pH of about 6 to about 9; and drying under reduced pressure to yield a lubricant including an ionic liquid.

24 Claims, No Drawings

FATTY ACID AND ROSIN BASED IONIC LIQUIDS

CROSS-REFERENCE TO RELATED APPLICATIONS

This application claims the benefit of U.S. Provisional Application No. 62/510,732, filed 24 May 2017 titled: Fatty Acid and Rosin Based Ionic Liquids, which is hereby incorporated herein by reference.

BACKGROUND

1. Field of the Discovery

The present disclosure relates to ionic liquids made from naturally derived fatty acids and rosins, as well as methods of using and preparing the ionic liquids of the present disclosure. In particular, the disclosure provides ionic liquids derived from tall oil fatty acids (TOFA) and tall oil rosins, methods of making the same, and methods of using the ionic liquids of the present disclosure as a lubricant and/or a lubricant additive.

2. Background Information

The automobile and metalworking industries are always looking for low cost, environmentally friendly lubricants and lubricant additives that have high thermal stability and that are highly efficient. Many lubricants and lubricant additives currently used in the automobile and metalworking industries do not meet these performance criteria. In addition, most lubricants and lubricant additives are petroleum-based and thus, non-renewable.

Ionic liquids (ILs), which are low melting point salts comprising an anion and a cation, have been of interest for lubrication applications because ILs are nonvolatile, non-flammable, and are thermally, mechanically, and electrochemically stability.

ILs are defined as salts that are liquid at low temperature, such as below 100° C. and are made up of cationic-anionic pairs. Some common cations in ILs include imidazolium, pyridium, pyrrolidinium, ammonium, phosphonium and sulfonium. Some examples of anions in ILs include tosylate, alkylsulfate, methanesulfate, hexafluorophosphate, tetrafluoroborate, and halide. Since the revitalization of IL research in early 2000, ILs have been identified for potential applications as lubricants and lubricant additives, due to their high thermal stability, low vapor pressure, good conductivity, and high viscosity.

Some of the early studies have found that room-temperature ILs are a versatile lubricant. However, most of these ILs contain halogens, phosphorus, or sulfur elements, which under high temperature and pressure conditions (e.g., tribological conditions), would cause potential corrosive, toxic and other environmental issues. The most common anion source for ILs are tetrafluoroborate, hexafluorophosphate, and trifluoromethanesulfonate. These anions are difficult to synthesize and are also from non-renewable sources. Imidazolium, pyridium, and pyrrolidinium are the most commonly used cations for ILs, while cations choline and tetraalkylammonium are used to a lesser extent in ILs.

International Patent Application Publication WO2013158473 A1 describes alkyl, alkoxylated or aromatic functioned anions as ionic liquids for lubricant applications. International Patent Application Publication WO2015140822 A1 describes the use of fatty acid based ILs as a lubricant. In particular, the fatty acid based ILs utilized a fatty acid with the formula RCOO—, wherein R is a C4 to C30 alkyl or cycloalkyl groups, with oleic, stearic and linoleic acid represented in the Examples. Lubricant and lubricant additives based on these chemistries have shown high friction reducing and anti-wearing properties. Similarly, U.S. Patent Application Publication No. 2017/0009172A1 describes polyether carboxylate/alkyl ammonium ILs with good thermal stability and friction reduction capacity, as determined by the Tapping Torque test method.

Prior to the present disclosure, lubricant and lubricant additives with fatty acid based ILs has been limited to select, pure fatty acids and their derivatives. Use of a select, pure fatty acid limits the potential applications for fatty acid based ILs because of the high costs associated with using pure fatty acids.

In Pine chemical industry, tall oil fatty acids (TOFA), distilled tall oil (DTO), as well as various grades of rosins (e.g., tall oil rosin [TOR]) are produced. Thus, the TOFA and the rosins are obtained from renewable resources. Crude tall oil (CTO), a by-product of the wood pulping, is usually recovered from pine wood "black liquor" from the Kraft paper process. Crude tall oil contains about equal amount of TOFA and TOR. TOFA includes a complex mixture of fatty acids, including, e.g., palmitic, stearic, oleic, elaidic, and linoleic acids, and TOR normally contains abietic, neoabietic, pimaric, dehydroabietic, palustric, and isopimaric acids. Ingevity™ Altapyne® series (DTO), Diacid 1550 (diacid) and Tenax® 2010 (maleated TOFA or triacid) are produced based on the aforementioned chemistries.

There exists a need for a low cost, renewable lubricant or lubricant additive, as well as a cost and energy efficient process of producing the lubricant or lubricant additive. The present disclosure relates to the surprising and unexpected discovery that ionic liquids prepared from natural fatty acids anions obtained from the distillation of CTO results in an IL that effectively reduces the friction coefficient between two or more contact surfaces.

SUMMARY

The present disclosure relates to the surprising and unexpected discovery that ionic liquids derived from naturally derived fatty acids, naturally occurring rosin acids, and derivatives thereof have exceptional lubricating and anti-wear activity. As such, the ionic liquids of the present disclosure are therefore particular effective for use a lubricant or a lubricant additive.

According to an aspect, the present disclosure provides an ionic liquid that comprises an anion salt of at least one of a fatty acid, a rosin acid, or derivative thereof, wherein the anionic fatty acid, rosin acid, or derivative thereof is a liquid at a temperature of 100° C. or less.

In some embodiments, at least one of the fatty acid is a naturally derived fatty acid, the rosin acid is a naturally derived rosin acid, or a combination thereof.

In certain embodiments, at least one of the fatty acid, rosin acid, or both is a bio fraction obtained from processing plant materials (such as hardwood or softwood trees).

In other embodiments, the bio fraction has at least one of a fatty acid mixture or a derivative thereof, a rosin acid mixture or a derivative thereof, or a combination thereof.

In particular embodiments, the fatty acid comprises at least one of a plant oil, crude tall oil, tall oil fatty acid, distilled tall oil, coconut oil, palm oil, diacids from tall oil fatty acid, triacids derived from tall oil fatty acid, rosin, tall oil rosin, gum tree rosin, wood rosin, softwood rosin, hardwood rosin, derivatives thereof, or a combination thereof.

In additional embodiments, the rosin acid comprises at least one of crude tall oil, rosin, tall oil rosin, gum tree rosin, wood rosin, softwood rosin, hardwood rosin, tall oil fatty acid, distilled tall oil, derivatives thereof, or a combination thereof.

In another embodiment, the ionic liquid further comprises a cation selected from the group consisting of choline, imidazolium, pyridium, pyrrolidinium, ammonium, phosphonium, and sulfonium.

In a further embodiment, the ionic liquid is substantially or completely free of halogen.

In some embodiments, the ionic liquid is selected from the group consisting of cholinium tall oil fatty acid carboxylate, cholinium tall oil diacid carboxylate, cholinium tall oil rosin acid carboxylate, and tetrabutylammonium tall oil rosin acid carboxylate.

In any aspect or embodiment described herein, the ionic liquid has at least one of friction reducing properties.

In certain embodiments, the ionic liquid reduces the coefficient of friction between two surfaces by about 10 to about 70% (e.g., about 14 to about 65%).

According to a further aspect, the present disclosure provides a lubricant composition comprising the ionic liquid of the present disclosure.

In certain embodiments, the lubricant composition further comprises at least one additive.

In further embodiments, the additive is selected from the group consisting of a dispersant, a corrosion inhibitor, a detergent, an antioxidant, an anti-wear and extreme pressure additive, a viscosity improver, a friction improver, an oiliness improver, a metal deactivator, a demulsifier, a pour point depressant, a foam inhibitor, a seal-swelling agent, and an antimicrobial.

According to a further aspect, the present disclosure provides a method for making an ionic liquid or a lubricant composition. The method comprises: admixing a cation and an anion in a ratio of about a 1.5:1 to about 1:1.5 at room temperature to form a reaction mixture, wherein the anion comprises at least one of a fatty acid, a rosin acid, derivative thereof, or a combination thereof, and the cation comprises at least one of choline, imidazolium, pyridium, pyrrolidinium, ammonium, phosphonium, sulfonium, derivatives thereof, or a combination thereof; maintaining the reaction mixture at a pH of about 6 to about 9 (e.g., a pH of about 6 to about 7) and drying under reduced pressure to yield a lubricant comprising an ionic liquid.

In some embodiments, the method further comprises heating the mixture when the anion includes a rosin, a diacid, or a triacid.

In certain embodiments, the reaction mixture is at a temperature of about 80° C. or less (e.g., about 60° C. or less).

In another embodiment, the anion is a choline hydroxide aqueous solution, a tetrabutylammonium hydroxide aqueous solution, or 1-Ethyl-3-methylimidazolium (EMIM) hydroxide aqueous solution.

In other embodiments, at least one of the fatty acid is a naturally derived fatty acid, the rosin acid is a naturally derived rosin acid, or a combination thereof.

In particular embodiments, at least one of the fatty acid, rosin acid, or both is a bio fraction obtained from processing a plant (such as a hardwood or a softwood tree).

In further embodiments, the bio fraction has at least one of a fatty acid mixture or a derivative thereof, a rosin acid mixture or a derivative thereof, or a combination thereof.

In some embodiments, the fatty acid comprises at least one of a plant oil, crude tall oil, tall oil fatty acid, coconut oil, palm oil, diacids from tall oil fatty acid, triacids derived from tall oil fatty acid, derivatives thereof, or a combination thereof.

In additional embodiments, the rosin acid comprises at least one of crude tall oil, rosin, tall oil rosin, gum tree rosin, wood rosin, softwood rosin, hardwood rosin, derivatives thereof, or a combination thereof.

In other embodiments, the ionic liquid is substantially or completely free of halogen.

In any aspect or embodiment described herein, the ionic liquid has at least one of friction reducing property.

DETAILED DESCRIPTION

The following is a detailed description provided to aid those skilled in the art in practicing the present disclosure. Those of ordinary skill in the art may make modifications and variations in the embodiments described herein without departing from the spirit or scope of the present disclosure. Unless otherwise defined, all technical and scientific terms used herein have the same meaning as commonly understood by one of ordinary skill in the art to which this disclosure belongs. The terminology used in the description of the disclosure herein is for describing particular embodiments only and is not intended to be limiting of the disclosure. All publications, patent applications, patents, figures and other references mentioned herein are expressly incorporated by reference in their entirety.

The present disclosure provides an ionic liquid composition comprising an anion salt of at least one of a fatty acid, a rosin acid, or derivative thereof, wherein the anionic fatty acid, rosin acid, or derivative thereof is a liquid at a temperature of 100° C. or less, with the surprising and unexpected ability to be utilized as a lubricant or lubricant additive. The present disclosure further provides methods for making the ionic liquid of the present disclosure and the lubricant of the present disclosure. Surprisingly, all of the ionic liquids with oil fatty acid (TOFA) and tall oil rosin (TOR) derivatives had significant levels of water solubility and were liquid below 100° C. in neat form. The water solubility and liquid form of the ionic liquids of the present disclosure increase their potential in lubricant application.

The ionic liquid can be used as cost effective lubricant or lubricant additive that is derived from renewable resources. The ionic liquid of the present disclosure is derived from renewable resources (such as softwood trees and hardwood trees) and provides similar and often better friction reducing and/or anti-wearing properties than lubricants obtained from non-renewable resources.

Where a range of values is provided, it is understood that each intervening value, to the tenth of the unit of the lower limit unless the context clearly dictates otherwise (such as in the case of a group containing a number of carbon atoms in which case each carbon atom number falling within the range is provided), between the upper and lower limit of that range and any other stated or intervening value in that stated range is encompassed within the disclosure. The upper and lower limits of these smaller ranges may independently be included in the smaller ranges is also encompassed within the disclosure, subject to any specifically excluded limit in the stated range. Where the stated range includes one or both of the limits, ranges excluding either both of those included limits are also included in the disclosure.

The following terms are used to describe the present disclosure. Unless otherwise defined, all technical and scientific terms used herein have the same meaning as commonly understood by one of ordinary skill in the art to which this disclosure belongs. The terminology used in the description is for describing particular embodiments only and is not intended to be limiting of the disclosure.

The articles "a" and "an" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

As used herein in the specification and in the claims, the phrase "at least one," in reference to a list of one or more elements, should be understood to mean at least one element selected from anyone or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, in certain methods described herein that include more than one step or act, the order of the steps or acts of the method is not necessarily limited to the order in which the steps or acts of the method are recited unless the context indicates otherwise.

The Kraft process is the dominant method for producing wood pulp and tall oil is a by-product of this wood pulping process. After the digestion of wood chips, the wood pulp is sent for papermaking; the by-product, black liquor, is the source for crude tall oil (CTO). At the refineries, CTO is separated by distillation to produce heads, TOFA, distillated tall oil (DTO), TOR, and tall oil pitch (TOP).

The term "tall oil bio fraction", as used herein, includes crude tall oil and any fraction obtained from crude tall oil processing and/or distillation. For example, a tall oil bio fraction can include, but is not limited to, crude tall oil, tall oil fatty acids, distilled tall oil, heads, rosin, etc.

Ionic liquids (ILs) are defined as salts that are liquid at low temperature, which has generally been describes as 100° C. or less. ILs are known to have high viscosity, low vapor pressure, low combustibility, and high thermal stability. Due to unique properties of ILs, many potential applications have been identified, including lubricants and lubricant additives.

According to an aspect, the present disclosure provides an ionic liquid that comprises an anion salt of at least one of a fatty acid, a rosin acid, or derivative thereof, wherein the anionic fatty acid, rosin acid, or derivative thereof is a liquid at a temperature of 100° C. or less. In any aspect or embodiment described herein, the fatty acid can be a mixture of fatty acids. Similarly, in any aspect or embodiment described herein, the rosin acid can be a mixture of rosin acids.

In any aspect or embodiment described herein, the ionic liquids of the present disclosure further comprise a cation. The cation may include at least one cation selected from the group consisting of choline, imidazolium, pyridium, pyrrolidinium, ammonium, phosphonium, and sulfonium.

The ionic liquid of the present disclosure can be prepared from at least one of a naturally derived fatty acid, a naturally derived rosin acid, or a combination thereof. The naturally derived fatty acid and/or naturally derived rosin acid may be obtained from a bio fraction obtained from the processing of plant material, such as a hardwood tree or a softwood tree. For example, the fatty acid and/or rosin acid can be obtained from the distillation process of crude tall oil, such as tall oil fatty acids, distilled tall oil, rosin, or derivatives thereof. As such, the anionic salt of the ionic liquids may be TOFA, TOR, DTO, diacids (such as, diacids derived from TOFA), triacids (such as triacids derived from TOFA), and other products and derivatives from the Kraft paper process.

Additionally, the fatty acid may be at least one of a plant oil, crude tall oil, tall oil, TOFA, coconut oil, palm oil, TOR, gum rosin, diacids from tall oil fatty acid, triacids derived from tall oil fatty acid, wood rosin, softwood rosin, hardwood rosin, derivatives thereof, or a combination thereof.

In certain embodiments, the fatty acid or rosin acid is selected from the group of TOFA, TOR, diacid from TOFA, triacid from TOFA, and a mixture thereof. The rosin acid may comprise at least one of CTO, TOFA, rosin, tall oil rosin, gum tree rosin, wood rosin, softwood rosin, hardwood rosin, derivatives thereof, or a combination thereof.

TOFA normally includes palmitic, stearic, oleic, elaidic, and linoleic acids, and TOR normally contains abietic, neoabietic, pimaric, dehydroabietic, palustric, isopimaric acids. One skilled in the art appreciates that commercial TOFA contains some TOR, and commercial TOR also contains various levels of TOFA. Likewise, derivatives from TOFA and TOR, such diacids and triacids, esters, amides, amines and alcohols all contain various numbers of by-products. In addition, various chain lengths and isomers in TOFA and TOR would impact the formation of ionic liquids and their applications. However, one skilled in the art would be able to formulate an ionic liquid for a particular application using methods routine in the art.

In particular embodiments, the ionic liquid may be selected from the group consisting of cholinium tall oil fatty acid carboxylate, cholinium tall oil diacid carboxylate, cholinium tall oil rosin acid carboxylate, and tetrabutylammonium tall oil rosin acid carboxylate.

The results of the Twist Compression Test (TCT), which is a well-known test for evaluating lubricants and lubricant additives, of the Examples below demonstrate that the ionic liquids of the present disclosure reduce friction between surfaces. The inherent polarity of ionic liquids was found to provide a strong adsorption to the matting surfaces and to form a thin film of low shearing strength, thereby reducing friction and wear. In certain embodiments, the ionic liquid reduces the coefficient of friction between surfaces (as determined by TCT) by about 10 to about 95% (e.g., about 14 to about 65%) relative to, e.g., a non-ionic liquid salt of the fatty acid, the rosin acid, or derivative thereof, or non-treatment of the surface. For example, the ionic liquid may reduce the coefficient of friction between surfaces by about 10 to about 95%, about 10 to about 90%, about 10 to about 80%, about 10 to about 70%, about 10 to about 65%, about 10 to about 60%, about 10 to about 55%, about 10 to about 50%, about 10 to about 45%, about 10 to about 40%, about 10 to about 35%, about 10 to about 30%, about 15 to about 95%, about 15 to about 90%, about 15% to about 80%, about 15 to about 70%, about 15 to about 65%, about 15 to about 60%, about 15 to about 55%, about 15 to about 50%, about 15 to about 45%, about 15 to about 40%, about 15 to about 35%, about 20 to about 95%, about 20 to about 90%, about 20 to about 80%, about 20 to about 70%, about 20 to about 65%, about 20 to about 60%, about 20 to about 55%, about 20 to about 50%, about 20 to about 45%, about 20 to about 40%, about 25 to about 95%, about 25 to about 90%, about 25 to about 80%, about 25 to about 70%, about 25 to about 65%, about 25 to about 60%, about 25 to about 55%, about 25 to about 50%, about 25 to about 45%, about 30 to about 95%, about 30 to about 90%, about 30 to about 80%, about 30 to about 70%, about 30 to about 65%, about 30 to about 60%, about 30 to about 55%, about 30 to about 50%, about 35 to about 95%, about 35 to about 90%, about 35 to about 80%, about 35 to about 70%, about 35 to about 65%, about 35 to about 60%, about 35 to about 55%, about 40 to about 95%, about 40 to about 90%, about 40 to about 80%, about 40 to about 70%, about 40 to about 65%, about 40 to about 60%, about 45 to about 95%, about 45 to about 90%, about 45 to about 80%, about 45 to about 70%, about 45 to about 65%, about 50 to about 95%, about 50 to about 90%, about 50 to about 80%, about 50 to about 70%, about 55 to about 95%, about 55 to about 90%, about 55 to about 80%, about 60 to about 95%, about 60 to about 90%, about 60 to about 80%, about 65 to about 95%, about 65 to about 90%, about 65 to about 85%, about 70 to about 95%, about 70 to about 90%, or about 75 to about 95%, relative to, e.g., a non-ionic liquid salt of the fatty acid, the rosin acid, or derivative thereof, or non-treatment of the surface. In an embodiment, the ionic liquid may reduce the coefficient of friction between surfaces by about 10%, about 11%, about 12%, about 13%, about 14%, about 15%, about 16%, about 17%, about 18%, about 19%, about 20%, about 21%, about 22%, about 23%, about 24%, about 25%, about 26%, about 27%, about 28%, about 29%, about 30%, about 31%, about 32%, about 33%, about 34%, about 35%, about 36%, about 37%, about 38%, about 39%, about 40%, about 41%, about 42%, about 43%, about 44%, about 45%, about 46%, about 47%, about 48%, about 49%, about 50%, about 51%, about 52%, about 53%, about 54%, about 55%, about 56%, about 57%, about 58%, about 59%, about 60%, about 61%, about 62%, about 63%, about 64%, about 65%, about 66%, about 67%, about 68%, about 69%, about 70%, about 71%, about 72%, about 73%, about 74%, about 75%, about 76%, about 77%, about 78%, about 79%, about 80%, about 81%, about 82%, about 83%, about 84%, about 85%, about 86%, about 87%, about 88%, about 89%, about 90%, about 91%, about 92%, about 93%, about 94%, or about 95% relative to, e.g., a non-ionic liquid salt of the fatty acid, the rosin acid, or derivative thereof, or non-treatment of the surface.

In any aspect or embodiment described herein, the ionic liquid may be substantially or completely free of halogen. Halide free ionic liquid can be prepared by utilizing only hydroxide forms of the cation with fatty acids (e.g., TOFA or other nature fatty acids) or their derivatives. If a hydroxide form of the cation is not available (e.g., commercially available), an Amberlite® free base, e.g., can be utilized to carry out ion-exchange to convert corresponding halide to the corresponding hydroxide form prior to reacting with the fatty acid, the rosin acid, or a mixture thereof, with the cation (i.e., the hydroxide form). One skilled in the art would appreciate other methods of exchanging a halide from the halide form the cation for hydroxide or other non-halide forms of the cation.

In another embodiment, the ionic liquid is selected from the group consisting of cholinium tall oil fatty acid carboxylate, cholinium tall oil diacid carboxylate, cholinium tall oil rosin acid carboxylate, and tetrabutylammonium tall oil rosin acid carboxylate.

In a further aspect, the present disclosure provides a lubricant composition comprising the ionic liquid of the present disclosure. The lubricant composition may further comprise an additive, which may include at least one of a dispersant, a corrosion inhibitor, a detergent, an antioxidant, an anti-wear and extreme pressure additive, a viscosity improver, a friction improver, an oiliness improver, a metal deactivator, a demulsifier, a pour point depressant, a foam inhibitor, a seal-swelling agent, an antimicrobial, or a combination thereof. The aforementioned chemical additives may be used in conjunction with the ILs of the present disclosure in an amount effective to improve the performance characteristics and properties (e.g., reducing friction and/or wear between surfaces) of the IL lubricant composition, and as one skilled in the art appreciates may include any appropriate dispersant, corrosion inhibitor, detergent, antioxidant, anti-wear and extreme pressure additive, viscosity improver, friction improver, oiliness improver, metal deactivator, demulsifier, pour point depressant, foam inhibitor, seal-swelling agent, and/or antimicrobial known or that becomes known. Examples of the main chemical families for each of the above-mentioned additives include, but are not limited to:

Dispersants: succinic esters of polyols, polyolefin succinic acid ester, polyolecin succinic acid amid, polyolefin succinic acid ester-amide, succinimides, succinimades, mannich bases, or combinations thereof;

Corrosion inhibitors: benzotriazole, 1,2,4-triazole, benzimidazole, 2-alkyldithiobenzimidazole or 2-alkyldithiobenzothiazole, 1-amino-2-propanol, a derivative of dimercaptothiadiazole, octylamine octanoate, condensation products of dodecenyl succinic acid or anhydride or a fatty acid with a polyamine, or combinations thereof;

Detergents: zinc dithiophosphates (ZDDPs), phenates, sulfur containing phenates, sulfonates, salixarates, salicylates, hindered phenols, aromatic amines, phosphorus compounds, polysiloxanes, sulfurized fatty acid derivatives, or combinations thereof;

Antioxidants: hindered alkyl phenols, ZDDPs, phenolic antioxidant, aminic antioxidant, 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol, Irganox™ L-135 (Ciba), molybdenum dithiocarbamates antioxidants, Molyvan 822® (R.T. Vanderbilt Holding Chemicals, Inc., Norwalk, Conn., USA), Molyvan® A, Molyvan® 855, Adeka Sakura-Lube™ S-100, S-165, S-600 or 525, or combinations thereof;

Anti-wear and extreme pressure additives: ZDDPs, amine phosphates, titanium compounds, tartaric acid derivatives such as tartrate esters, amides or tartrimides, malic acid derivatives, citric acid derivatives, glycolic acid derivatives, oil soluble amine salts of phosphorus compounds different from that of the invention, sulphurized olefins, metal dihydrocarbyldithiophosphates (such as zinc dialkyldithiophosphates), phosphites (such as dibutyl phosphite), phosphonates, phosphate, ammonium phosphate salt, thiocarbamate-containing compounds, such as thiocarbamate esters, thiocarbamate amides, thiocarbamic ethers, alkylene-coupled thio-carbamates, and bis(S-alkyldithiocarbamyl) disulfides, a tartrate or tartrimide as disclosed in International Publication WO 2006/044411 or Canadian Patent CA 1 183 125, a citrate as is disclosed in U.S. Patent Application Publication No. 20050198894, or combinations thereof;

Metal deactivators: a derivative of benzotriazole (typically tolyltriazole), 1,2,4-triazole, benzimidazole, 2-alkyldithiobenzimidazole or 2-alkyldithiobenzothiazole, 1-amino-2-propanol, a derivative of dimercaptothiadiazole, octylamine octanoate, condensation products of dodecenyl succinic acid or anhydride, a fatty acid such as oleic acid with a polyamine, a corrosion inhibitor, or a combination thereof;

Foam inhibitors: polydimethylsiloxanes, polyacrylates, polysiloxanes, copolymers of ethyl acrylate and 2-ethylhexylacrylate and optionally vinyl acetate, or combinations thereof;

Friction improvers: long chain fatty acid derivatives of amines, fatty esters, or fatty epoxides; molybdenum dithiocarbamate; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters such as glycerol mono-oleate; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof; or combinations thereof.

Demulsifier: fluorinated polysiloxanes, trialkyl phosphates, polymers and copolymers of ethylene glycol, polyethylene glycols, polyethylene oxides, polypropylene oxides, (ethylene oxide-propylene oxide) polymers, or combinations thereof;

Pour point depressants: polyalkylacrylate, polyalkylmethacrylate, polyalphaolefins, esters of maleic anhydride-styrene copolymers, poly(meth)acrylates, polyacrylates, polyacrylamides, or combinations thereof;

Seal-swelling agent: sulfolene derivatives Exxon Necton-37 (FN 1380) and Exxon Mineral Seal Oil (FN 3200);

Antimicrobial: o-phenylphenol, morpholine, and the like; and

Viscosity improvers: hydrogenated styrene-butadiene rubbers, ethylene-propylene copolymers, polymethacrylates, polyacrylates, hydrogenated styrene-isoprene polymers, hydrogenated diene polymers, polyalkyl styrenes, polyolefins, esters of maleic anhydride-olefin copolymers, esters of maleic anhydride-styrene copolymers, or combinations thereof.

The present disclosure further provides a method for the preparation of a lubricant composition. The method comprises: admixing a cation and an anion in a molar ratio of about a 1.5:1 to about 1:1.5 (e.g., a molar ratio of about a 1.2:1 to about 1:1.2) at room temperature to form a reaction mixture, wherein the anion comprises at least one of a fatty acid, a rosin acid, derivative thereof, or a combination thereof, and the cation comprises at least one of choline, imidazolium, pyridium, pyrrolidinium, ammonium, phosphonium, sulfonium, derivatives thereof, or a combination thereof; maintaining the reaction mixture at a pH of about 6 to about 9 (e.g., about 6, about 6.5 about 7, about 7.5, about 8, about 8.5, or about 9); and drying under reduced pressure to yield a lubricant comprising an ionic liquid. When the anionic salt includes a rosin, a diacid, or a triacid, the method may further comprise heating the mixture. For example the mixture may be heated to 80° C. or less (e.g., about 75° C. or less, about 70° C. or less, about 65° C. or less, about 60° C. or less, about 55° C. or less, about 50° C. or less, about 45° C. or less, about 40° C. or less, about 35° C. or less, or about 30° C. or less). In other embodiments, the mixture is heated to about 30° C. to about 80° C., about 30° C. to about 70° C., about 30° C. to about 60° C., about 30° C. to about 50° C., about 30° C. to about 40° C., about 40° C. to about 80° C., about 40° C. to about 70° C., about 40° C. to about 60° C., about 40° C. to about 50° C., about 50° C. to about 80° C., about 50° C. to about 70° C., about 50° C. to about 60° C., about 60° C. to about 80° C., about 60° C. to about 70° C., or about 70° C. to about 80° C.

In some embodiments, the reaction mixture is maintained as a pH in a range of about 6 to about 9, about 6 to about 8, about 6 to about 7, about 7 to about 9, about 7 to about 8, or about 8 to about 9. A pH on the lower end of the ranges described herein is preferable because it reduces the likelihood of amine remaining in the solution.

In other embodiments, molar ratio of the cation to the anion is about a 1.5:1 to about 1:1.5, about 1.5:1 to about 1:1.4, about 1.5:1 to about 1:1.3, about 1.5:1 to about 1:1.2, about 1.5:1 to about 1:1.1, about 1.5:1 to about 1:1, 1.4:1 to about 1:1.5, about 1.4:1 to about 1:1.4, about 1.4:1 to about 1:1.3, about 1.4:1 to about 1:1.2, about 1.4:1 to about 1:1.1, about 1.4:1 to about 1:1, 1.3:1 to about 1:1.5, about 1.3:1 to about 1:1.4, about 1.3:1 to about 1:1.3, about 1.3:1 to about 1:1.2, about 1.3:1 to about 1:1.1, about 1.3:1 to about 1:1, 1.2:1 to about 1:1.5, about 1.2:1 to about 1:1.4, about 1.2:1 to about 1:1.3, about 1.2:1 to about 1:1.2, about 1.2:1 to about 1:1.1, about 1.2:1 to about 1:1, a 1.1:1 to about 1:1.5, about 1.1:1 to about 1:1.4, about 1.1:1 to about 1:1.3, about 1.1:1 to about 1:1.2, about 1.1:1 to about 1:1.1, about 1.1:1 to about 1:1, 1:1 to about 1:1.5, about 1:1 to about 1:1.4, about 1:1 to about 1:1.3, about 1:1 to about 1:1.2, or about 1:1 to about 1:1.1.

In certain embodiments, the anion may be a choline hydroxide aqueous solution, a tetrabutylammonium hydroxide aqueous solution, or 1-Ethyl-3-methylimidazolium (EMIM) hydroxide aqueous solution.

In certain embodiments, at least one of the fatty acid, the rosin acid, or both are naturally derived. Furthermore, as discussed herein, the fatty acid, the rosin acid, or both, may be a bio fraction obtained from processing a plant (such as a hardwood or a softwood tree). The bio fraction may have a fatty acid mixture or a derivative thereof, a rosin acid mixture or a derivative thereof, or a combination thereof.

In any aspect or embodiment described herein, the fatty acid comprises at least one of a plant oil, crude tall oil, tall oil fatty acid, distilled tall oil, coconut oil, palm oil, diacids from tall oil fatty acid, triacids derived from tall oil fatty acid, rosin, tall oil rosin, gum tree rosin, wood rosin, softwood rosin, hardwood rosin, derivatives thereof, or a combination thereof.

In any aspect or embodiment described herein, the rosin acid comprises at least one of crude tall oil, rosin, tall oil rosin, gum tree rosin, wood rosin, softwood rosin, hardwood rosin, tall oil fatty acid, distilled tall oil, derivatives thereof, or a combination thereof.

As discussed herein, the resultant lubricant composition has friction reducing properties and/or anti-wear properties.

EXAMPLES

Example 1—Preparation and Compositional Analysis of Exemplary Ionic Liquids of the Present Disclosure Made with Choline TOFA, modified TOFA, or rosin was mixed in a 1/1 molar ratio with choline hydroxide aqueous (20%) solution at room temperature with magnetic stirring in a flask. Heat was applied (50° C.) for solutions that included reactions with diacids, triacids and/or rosin. The pH was monitored to ensure the mixture had pH=7. Once the reactants were dissolved, where required, water was added to adjust the sample's concentration. Alternatively, if neat sample was required, the crude product was put in a vacuum oven at 80° C. and 20 mmHg for 24 hours. The ionic liquid was then characterized by gas chromatography (GC) and Fourier Transform-Infrared Spectroscopy (FT-IR).

Example 2—Preparation and Compositional Analysis of Exemplary Ionic Liquids of the Present Disclosure Made with Tetrabutylammonium TOFA, modified TOFA, or rosin was mixed in a 1/1 molar ratio with tetrabutylammonium hydroxide aqueous solution (40%) at room temperature with magnetic stirring in a beaker. Heat (50° C.) was applied to reactions with Tenax® 2010 and rosin reaction. The pH was monitored to ensure mixture had pH=7. After all reactants were dissolved, water was added to adjust the proper concentration. Alternatively, if neat sample was required, the crude product was put in a vacuum oven at 80° C. and 20 mmHg for 24 hours. The ionic liquid was then characterized by GC and FT-IR.

Example 3—Preparation and Compositional Analysis of Exemplary Ionic Liquids of the Present Disclosure Made with 1-Ethyl-3-methylimidazolium TOFA, modified TOFA or rosin was mixed in a 1/1 molar ratio with 1-Ethyl-3-methylimidazolium (EMIM) hydroxide aqueous solution at room temperature with magnetic stirring in a beaker. The EMIM hydroxide was prepared by passing 15% 1-Ethyl-3-methylimidazolium (EMIM) chloride solution through a packed column of Amberlite® IRN78 hydroxide form to exchange chloride to hydroxide. The ratio was 0.1 mole C1 to 100 g IRN-78. The filtrate was used without further purification. Heat (50° C.) was applied to reactions with Tenax® 2010 or rosin. The pH was monitored to ensure mixture had pH=7. Once the reactants were dissolved, where required, water was added to adjust the concentration. Alternatively, if neat sample was required, the crude product was put in a vacuum oven at 80° C. and 20 mmHg for 24 hours. The ionic liquid was then characterized by GC and FT-IR.

Example 4—Twist Compression Analysis of Exemplary Ionic Liquids of the Present Disclosure The industry standard Twist Compression Test (TCT) was utilized to compare exemplary ionic liquids of the present disclosure with fatty acid triethanolammonium (TEA) salt or rosin acid TEA salt. Briefly, a 25 mm annular cylinder rotates between 6-18 rpm or 7-20 mm/s, and pressure is set to best simulate the process. A coefficient of friction (COF or $\mu$) was calculated for each sample by taking a ratio of transmitted torque (i.e., the force of friction between the two bodies) to applied pressure (i.e., the force pressing the two bodies together).

Dynamic tests were run on the Twist Compression Test at 10 RPM and 3,118 psi interface pressure, on cold rolled steel (i.e., the rotating tool was brought slowly into contact with the lubricated sheet). Each sample was applied in excess when tested using a disposable pipette. Tests were run until sample broke down. The data was collected at 50 Hz. Test results are summarized in Table 1 below. The time until breakdown (TBD) was set at the base of the slope leading to very high COF levels or instability in the COF vs. time graph, and likely ionic liquid film failure. The initial peak COF was set at the coefficient of friction when the test reached full pressure. The friction at five seconds is the instantaneous COF five seconds after the test reached full test pressure. The average COF is the average coefficient of friction between the initial peak COF and the time until breakdown. The friction factor integrates the initial peak COF, the average COF and the TBD results into one number. In particular, the friction factor is the time until breakdown divided by the weighted average of initial peak COF and average COF. The weights assigned are 20% initial peak and 80% average friction. Table 1 summarizes the obtained test results. Better performing lubricants have higher TCT friction factor numbers.

TABLE 1

Twist Compression testing result of tall oil based ionic liquids

| | TCT friction | rank |
|---|---|---|
| Triethanolammonium tall oil fatty acid carboxylate | 107 | 3 |
| cholinium tall oil fatty acid carboxylate | 125 | 2 |
| cholinium tall oil diacid carboxylate | 53 | 5 |
| cholinium tall oil triacid carboxylate | 31 | 6 |
| Triethanolammonium tall oil diacid carboxylate | 20 | 8 |
| Triethanolammonium tall oil triacid carboxylate | 23 | 7 |
| cholinium tall oil rosin acid carboxylate | 91 | 4 |
| tetrabutylammonium tall oil rosin acid carboxylate | 126 | 1 |

The ILs are being compared to TEA salts, which are non-ionic liquids that are commonly used in the lubricant industry. For example, choline TOFA (125) and tetrabutylammonium rosin (126) ILs both demonstrated higher TCT friction numbers as compared to the control TEA salt of TOFA (107). Similarly, the TOFA diacid and triacid choline salts (31 and 53, respectively) each performed better than their corresponding diacid and triacid TEA salts (23 and 20, respectively). Overall, the rosin based tetrabutylammonium salt was the best performer for the TCT friction test. It performed slightly better than that of tall oil fatty acid choline salt.

The results demonstrate that rosin-based, multi-carboxylic acid based, and fatty acid based ILs each perform well as lubricants.

What is claimed is:

1. An ionic liquid comprising:

an anion salt of at least one fatty acid or derivative thereof; and at least one rosin acid or derivative thereof, wherein the anionic fatty acid or derivative thereof and the rosin acid or derivative thereof is a liquid at a temperature of 100° C. or less.

2. The ionic liquid of claim 1, wherein the at least one fatty acid is a naturally derived fatty acid, the at least one rosin acid is a naturally derived rosin acid, or a combination thereof.

3. The ionic liquid of claim 1, wherein the at least one fatty acid and the at least one rosin acid are a bio fraction obtained from processing plant materials.

4. The ionic liquid of claim 3, wherein the bio fraction has a fatty acid mixture and a rosin acid mixture.

5. The ionic liquid of claim 4, wherein the bio fraction comprises at least one of a plant oil, crude tall oil, tall oil fatty acid, distilled tall oil, coconut oil, palm oil, diacids from tall oil fatty acid, triacids derived from tall oil fatty acid, rosin, tall oil rosin, gum tree rosin, wood rosin, softwood rosin, hardwood rosin, derivatives thereof, or a combination thereof.

6. The ionic liquid of claim 1, further comprising a cation selected from the group consisting of choline, imidazolium, pyridium, pyrrolidinium, ammonium, phosphonium, and sulfonium.

7. The ionic liquid of claim 6, wherein the ionic liquid is substantially or completely free of halogen.

8. The ionic liquid of claim 1, wherein ionic liquid comprises at least one of cholinium tall oil fatty acid carboxylate, cholinium tall oil diacid carboxylate, cholinium tall oil rosin acid carboxylate, tetrabutylammonium tall oil rosin acid carboxylate, or a combination thereof.

9. The ionic liquid of claim 8, wherein the ionic liquid reduces the coefficient of friction between two surfaces by about 10 to about 95%.

10. The ionic liquid of claim 8, wherein the ionic liquid reduces the coefficient of friction between two surface by at least about 0.5 fold relative to a non-ionic liquid salt of the fatty acid, the rosin acid, or derivative thereof, or non-treatment of the surface.

11. A lubricant composition comprising the ionic liquid of claim 1.

12. The lubricant composition of claim 11, wherein the composition further comprises at least one additive.

13. The lubricant composition of claim 12, wherein the additive is at least one of a dispersant, a corrosion inhibitor, a detergent, an antioxidant, an anti-wear and extreme pressure additive, a viscosity improver, a friction improver, an oiliness improver, a metal deactivator, a demulsifier, a pour point depressant, a foam inhibitor, a seal-swelling agent or an antimicrobial.

14. A method for making an ionic liquid or a lubricant composition, the method comprising:

admixing a cation and an anion in a molar ratio of about a 1.5:1 to about 1:1.5 at room temperature to form a reaction mixture, wherein the anion comprises a fatty acid or a derivative thereof and a rosin acid or a derivative thereof, and the cation comprises at least one of choline, imidazolium, pyridium, pyrrolidinium, ammonium, phosphonium, sulfonium, derivatives thereof, or a combination thereof; and maintaining the reaction mixture at a pH of about 6 to about 9.

15. The method of claim 14, further comprising heating the mixture when the anion comprises a diacid, or a triacid.

16. The method of claim 15, wherein the reaction mixture is at a temperature of about 80° C. or less.

17. The method of claim 16, wherein the at least one fatty acid is a naturally derived fatty acid, the rosin acid is a naturally derived rosin acid, or a combination thereof.

18. The method of claim 17, wherein at least one of the fatty acid and the at least one of the rosin acid, are a bio fraction obtained from processing a plant.

19. The method of claim 18, wherein the bio fraction has at least one of a fatty acid mixture or a derivative thereof and a rosin acid mixture or a derivative thereof.

20. The method of claim 18, wherein the biofraction comprises at least one of a plant oil, crude tall oil, tall oil fatty acid, distilled tall oil, coconut oil, palm oil, diacid of a tall oil fatty acid, triacid of a tall oil fatty acid, rosin, tall oil rosin, gum tree rosin, wood rosin, softwood rosin, hardwood rosin, derivatives thereof, or a combination thereof.

21. The method of claim 14, wherein the ionic liquid reduces the coefficient of friction between two surfaces by about 10 to about 70%.

22. The method of claim 21, wherein the ionic liquid reduces the coefficient of friction between two surfaces by about 14 to about 65%.

23. The ionic liquid of claim 1, wherein the derivative of the at least one fatty acid, the derivative of the at least one rosin acid, or a combination thereof comprise a di-carboxylic acid, a tri-carboxylic acid, an alcohol, an ester, an amide, or a combination thereof.

24. The method of claim 14, further comprising drying under reduced pressure.

* * * * *